US008151898B2

(12) United States Patent
Merchant

(10) Patent No.: US 8,151,898 B2
(45) Date of Patent: Apr. 10, 2012

(54) FIRE SUPPRESSION DEVICE AND METHOD FOR USING

(75) Inventor: Matthew Merchant, Vinton, IA (US)

(73) Assignee: Alphagen Materials Technology, Inc., Vinton, IA (US)

( * ) Notice: Subject to any disclaimer, the term of this patent is extended or adjusted under 35 U.S.C. 154(b) by 136 days.

(21) Appl. No.: 12/428,814

(22) Filed: Apr. 23, 2009

(65) Prior Publication Data

US 2010/0270040 A1 Oct. 28, 2010

(51) Int. Cl.
*A62C 2/00* (2006.01)

(52) U.S. Cl. ..... 169/46; 169/45; 169/48; 169/49; 169/54; 52/3; 442/302; 442/414; 428/920

(58) Field of Classification Search ..... 169/43, 169/46, 48, 49, 54, 45; 52/3, 5, DIG. 12; 442/302, 414; 428/920, 921
See application file for complete search history.

(56) References Cited

U.S. PATENT DOCUMENTS

| | | | | |
|---|---|---|---|---|
| 1,521,285 | A | 12/1924 | Erickson | |
| 4,131,703 | A | 12/1978 | Voet | |
| 4,822,659 | A | 4/1989 | Anderson | |
| 5,083,408 | A | 1/1992 | Blom | |
| 5,232,976 | A | 8/1993 | Horacek | |
| 5,311,713 | A | 5/1994 | Goodrich | |
| 5,423,150 | A * | 6/1995 | Hitchcock | 169/48 |
| 5,746,031 | A | 5/1998 | Burns | |
| 6,016,889 | A | 1/2000 | Pearcy | |
| 6,074,714 | A | 6/2000 | Gottfried | |
| 6,500,555 | B1 | 12/2002 | Khaldi | |
| 6,706,793 | B2 | 3/2004 | Abu-Isa | |
| 6,742,305 | B2 * | 6/2004 | Rogers et al. | 52/3 |
| 7,395,869 | B2 * | 7/2008 | Schnabel et al. | 169/48 |
| 7,479,513 | B2 | 1/2009 | Reinheimer | |
| 7,568,528 | B1 * | 8/2009 | Miller et al. | 428/921 |
| 7,686,094 | B2 * | 3/2010 | Kleff | 52/DIG. 12 |
| 2001/0040166 | A1 | 11/2001 | Pietrantoni | |
| 2002/0095905 | A1 | 7/2002 | Fawley | |
| 2007/0248805 | A1 | 10/2007 | Orologio | |

OTHER PUBLICATIONS

Osmose, Fire-Guard—Fire Protective Coating for Wood Utility Poles, Brochure, published at least as early as May 2003.

* cited by examiner

*Primary Examiner* — Steven J Ganey
(74) *Attorney, Agent, or Firm* — Ryan N. Carter

(57) ABSTRACT

A wildfire suppressor made from a composite mixture bonded by a resin. The suppressor may be cylindrically shaped so that it wraps around a wooden utility pole or it may be a flat sheet adapted to be used under shingles or siding on a house or other suitable building. The fire suppressor comprises two layers. The first layer is adapted to reflect heat and is located on the outer portion of the sheet. The second layer is located closer to the object being protected. Above a certain predetermined temperature the second layer undergoes a chemical reaction to help protect the pole, building, or other object being protected.

12 Claims, 2 Drawing Sheets

FIRE SUPPRESSION DEVICE AND METHOD FOR USING

BACKGROUND

Wildfires are a common problem throughout the western United States and other semi-arid regions of the world. As population expands into such areas, utilities must be provided, such as electrical and telephone service, which utilities require the stringing of wires on utility poles. Utility poles are generally wooden structures, wherein the wood is treated to resist insect damage and to resist the rotting effects of water. However, such treatment also tends to make the utility poles more susceptible to fire, as such treatments generally involve some form of petrochemicals which are impregnated into the wood of the utility pole.

Every year many utility poles are lost in wildfires. This causes a service interruption to the utility's customers as well as the expense of replacing the poles. There is therefore a need for a fire suppressor capable of protecting utility poles and other objects from fire damage.

SUMMARY

A wildfire suppressor made from a composite mixture bonded by a resin. The suppressor may be cylindrically shaped so that it wraps around a wooden utility pole or it may be a flat sheet adapted to be used under shingles or siding on a house or other suitable building. The fire suppressor comprises two layers. The first layer is adapted to reflect heat and is located on the outer portion of the sheet. The second layer is located closer to the object being protected. Above a certain predetermined temperature the second layer undergoes a chemical reaction to help protect the pole, building, or other object being protected.

DETAILED DESCRIPTION

The present invention comprises a wildfire suppressor as generally shown in FIGS. 1-5. The suppressor is a semi-flexible composite mixture made from a commercially available filler material combined with a resin. In the embodiment shown in FIGS. 1 and 2, the suppressor is a cylindrically shaped pole sheet 14 having an open top and an open bottom. The sheet 14 is adapted to wrap around a wooden utility pole 10 or other cylindrical object. In the embodiment shown in FIG. 3, the suppressor is a flat sheet 16 adapted to be used between a roof and its shingles or between siding and studding on a house or other suitable structure. In an alternate embodiment, the suppressor is created in a liquid form and then sprayed onto the object to be protected.

Figure 1:
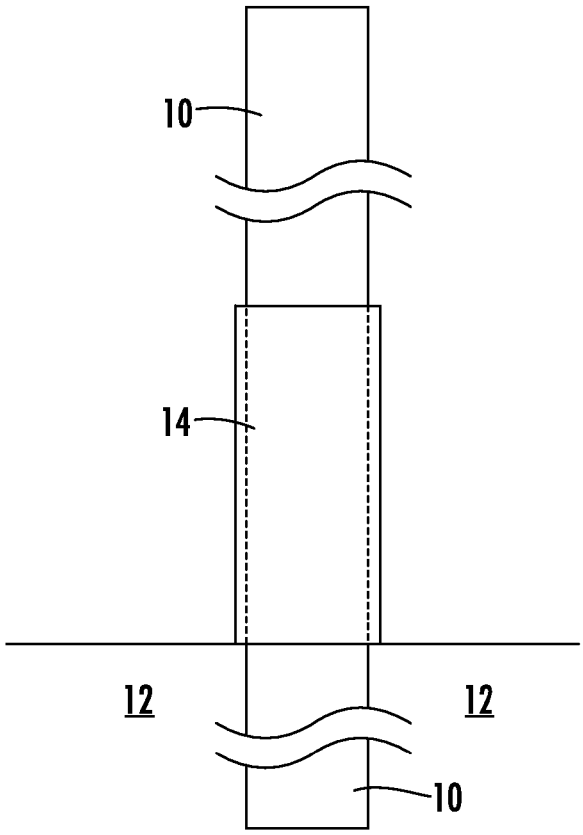
FIG. 1 is a side view of the cylindrical pole sheet embodiment of the fire suppressor.
Figure 2:
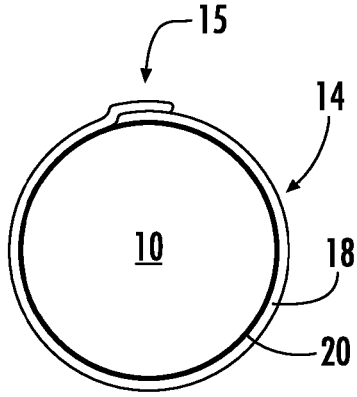
FIG. 2 is a top view of the embodiment shown in FIG. 1 wherein the pole sheet is in its closed position.

FIGS. 1 and 2 show the cylindrically shaped pole sheet 14 embodiment combined with a wooden utility pole 10. As shown, the pole sheet 14 circumferentially extends around the outer surface of the pole 10 to cover and protect the pole 10. FIG. 1 shows that a portion of the pole sheet 14 may extend below the ground 12 surface to ensure that the lower portion of the pole 10 is completely covered. The pole sheet 14 may extend any suitable distance up the pole 10 depending on the type and height of grass and shrubs adjacent to the pole 10. In one embodiment, the height of the pole sheet 14 extends about six feet above the ground surface 12, however, it will be recognized that the higher the grass and shrubs adjacent to the pole 10, the higher the pole sheet 14 should extend up the pole 10. Alternatively, instead of increasing the size of a single sheet 14 in areas with higher grass and shrubs, multiple sheets 14 may be combined with a single pole 10 to protect the higher portions of the pole 10.

FIG. 2 shows that in one embodiment the cylindrical pole sheet 14 has a length that is longer than the circumference of the utility pole 10 which results in overlapping portion 15 of the sheet 14. The extra length of the pole sheet 14 helps to ensure that the pole sheet 14 completely covers the pole 10, even in instances where the utility pole 10 has a circumference slightly larger than expected due to size variation, manufacture error, or swelling of the wood. In addition, the extra length of the pole sheet 14 helps to ensure that the pole 10 remains protected even when the second layer 20 expands (as discussed below). The pole sheet 14 is preferably made from a semi-rigid material that allows the overlapping ends 13, 17 of the pole sheet 14 to be stretched into an open position (FIG. 4) to be placed around a utility pole 10. The pole sheet 14 is biased in its closed position (FIG. 2) so that it returns to its closed position after it is placed around the pole 10.

Figure 5:
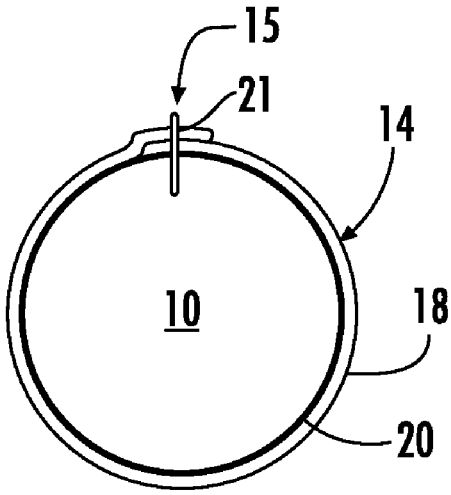
FIG. 5 is a top view of the embodiment shown in FIG. 1 wherein a mechanical fastener helps secure the sheet to the pole.

In the embodiment shown in FIG. 5, a mechanical fastener 21 is used to secure the sheet 14 to the pole 10. The fastener 21 helps to ensure that the sheet 14 remains in place and does not travel up the pole 10 leaving the bottom of the pole 10 exposed. The fastener 21 may be a snap, nail, screw, or any other fastener suitable for securing the ends 13, 17 together.

Figure 3:
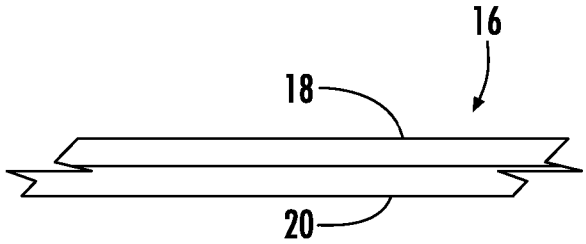
FIG. 3 is a top view of the flat sheet embodiment of the fire suppressor.
Figure 4:
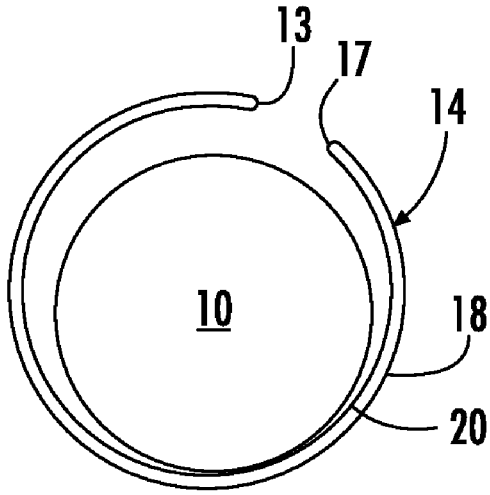
FIG. 4 is a top view of the embodiment shown in FIG. 1 wherein the pole sheet is in its open position.

As shown in FIGS. 2-4, the fire suppressor comprises two layers. The first layer 18 is a reflective outer layer. It is comprised of a ceramic material that reflects infrared (heat) energy during a fire. This first layer 18 is adapted to protect the pole 10 (or other object) up to about 300 to 400 degrees Fahrenheit by reflecting about 98% of the heat energy created by the fire. The second layer 20 is located inside the first layer 18 and is thus located closer to the object being protected. The second layer 20 contains an expandable graphite compound that is either sprayed on the sheet 14, 16 after its manufacture or manufactured as a component of the sheet 14, 16. One examples of an expandable graphite compound is described in U.S. Pat. No. 7,479,513 (Reinheimer et. al.) the disclosure of which is hereby incorporated by reference. The second layer 20 helps protect the wood utility pole 10 when the temperature rises above a predetermined onset temperature. When heated to a temperature above the onset temperature, the expandable graphite in the second layer 20, expands greatly. This makes the second layer a very poor conductor of heat energy while also occluding the oxygen necessary for combustion to help prevent the pole 10 from burning. The onset temperature is lower than the temperature required to pyrolyze the pole 10. In one embodiment, the onset temperature for the expandable graphite is about 200-400 degrees Fahrenheit. However, it should be noted that the temperature of the fire on the suppressor would have to be significantly hotter than 200-400 degrees to activate the second layer 20 since the second layer 20 is protected by the first layer 18.

In certain fire conditions, even though the fire suppressor prevents the pole 10 from burning, the pole 10 may be exposed to very high heat which could cause some damage to the integrity of the pole 10. If this fire damage is primarily behind the sheet 14, 16, it may be difficult to see when walking or flying by the scene of the fire. To help identify which poles 10 may have sustained damage, some embodiments of the invention include a color changing feature wherein the exterior of the sheet 14, 16 changes colors if it is exposed to a certain predetermine temperature. Thus, after a fire, the pole 10 should still be standing thereby providing service to the community, but the change in color of the coating will inform the maintenance personnel of the need to inspect the pole 10 to determine its structural integrity.

In one embodiment, the first layer 18 gives off water vapor at a predetermined temperature to help cool the layer 18 and extinguish the fire. In some embodiments, the first layer 18 comprises microscopic water droplets encapsulated in the matrix. These microscopic droplets are given off as water vapor at a predetermined temperature. In some embodiments, the first layer 18 comprises Alumina Trihydrate. Alumina Trihydrate (ATH or hydrated alumina) is a non-toxic, non-corrosive, flame retardant and smoke suppressant. ATH is a very effective flame retardant due to its thermodynamic properties which absorb heat and release water vapor. Alumina trihydrate releases its 35% water of crystallization as water vapor when heated above about 400 degrees Fahrenheit. The resulting endothermic reaction cools the product below flash point, reducing the risk of fire and acts as a vapor barrier to prevent oxygen from reaching the flame.

In addition to the fire suppression qualities of the cylindrical sheet 14, the sheet 14 also provides other benefits. The tensile strength of the sheet's 14 composite material helps support the pole 10 to prevent breakage from ice or wind loading. Further, in desert areas, the sheet 14 protects the pole 10 from the constant barrage of sand. Still further, the sheet 14 helps protect the pole 10 from moisture, bacteria, insects, and borers.

In use, the present invention is very effective at protecting objects from fire because certain embodiments provide multiple mechanisms for protection. First, the sheet 14, 16 is secured to (or around) the object to be protected. As fire approaches the object, the first layer reflects about 98% of the heat up to about 300-400 degrees Fahrenheit. If the first layer 18 gets hotter than that, water vapor is released from the first layer 18 to help cool the first layer 18 and extinguish the fire. If the fire continues to heat the suppressor, the second layer 20 is transformed from its first state to its second state thereby making it a very poor conductor while also occluding the oxygen necessary for combustion to help prevent the object from burning.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is as follows:

1. A fire suppressor sheet having two ends, said suppressor for protecting a cylindrically shaped object from excessive heat, said suppressor comprising:

a first layer forming a first side of the sheet, said first layer comprised of a heat reflective material;

a second layer combined with the first layer and forming a second side of the sheet, wherein the second layer is comprised of a material that expands to become a poor conductor of heat above a predetermined temperature;

wherein the sheet is movable between a first position and a second position, in the first position the sheet is generally cylindrically shaped to form an opening which is adapted to receive the cylindrical object, in the second position the ends of the sheet are separated to allow the object to be received by the opening;

wherein the sheet is biased in the first position;

wherein the second side of the sheet is adjacent to the opening when the sheet is in the first position.

2. The suppressor of claim 1 wherein the length of the sheet is longer than the circumference of the cylindrical object which results in the two ends of the sheet overlapping when the sheet is in the closed position.

3. The suppressor of claim 1 wherein the first layer is comprised of a ceramic material.

4. The suppressor of claim 1 wherein the second layer is comprised of an expandable graphite material.

5. The suppressor of claim 1 wherein the first layer comprises Alumina Trihydrate.

6. A suppressor sheet having two ends, said suppressor sheet for protecting cylindrically shaped object from excessive heat, said suppressor comprising:

a first layer forming a first side of the sheet for reflecting heat, wherein the first layer permanently changes from a first color to a second color when it is exposed to a first predetermined temperature;

a second layer combined with the first layer and forming a second side of the sheet, wherein the second layer expands to become a poor conductor of heat above a second predetermined temperature;

wherein the sheet is movable between a first position and a second position, in the first position the sheet is generally cylindrically shaped to form an opening which is adapted to receive the cylindrical object, in the second position the ends of the sheet are separated to allow the object to be received by the opening;

wherein the sheet is biased in the first position;

wherein the second side of the sheet is adjacent to the opening when the sheet is in the first position.

7. A suppressor sheet having two ends, said suppressor sheet for protecting cylindrically shaped object from excessive heat, said suppressor comprising:

a first layer made from a ceramic material and forming a first side of the sheet, wherein the first layer changes color when exposed to a first predetermined temperature;

a second layer combined with the first layer and forming a second side of the sheet, wherein the second layer is made from an expandable graphite compound, wherein the second layer expands to become a poor conductor of heat above a second predetermined temperature;

wherein the sheet is movable between a first position and a second position, in the first position the sheet is generally cylindrically shaped to form an opening which is adapted to receive the cylindrical object, in the second position the ends of the sheet are separated to allow the object to be received by the opening;

wherein the sheet is biased in the first position;

wherein the second side of the sheet is adjacent to the opening when the sheet is in the first position.

8. A method of using a fire suppressor sheet to protect an object from heat during a fire wherein the sheet comprises a first layer combined with a second layer and two ends, and wherein the sheet is movable between a first position in which it is generally cylindrically shaped and a second position in which the ends are separated, said sheet being biased in its first position, said method comprising the steps of:

securing the sheet to the object by moving the sheet from the first position to the second position, placing the sheet around the object, then letting the sheet retract to the first position, wherein the second layer is positioned closer to the object than the first layer after the sheet has been secured to the object;

reflecting heat from the fire with the first layer to protect the object;

above a first predetermined temperature, releasing water vapor from the first layer to help cool and extinguish the fire;

above a second predetermined temperature, expanding the second layer so that it becomes a poor conductor of heat and so that it occludes the oxygen necessary for combustion of the object.

9. The method of claim 8 further comprising the step of changing the color of the external portion of the sheet when the sheet is exposed to a third predetermined temperature.

10. The method of claim 8 further comprising the step of viewing the first layer to determine whether a color change has occurred.

11. The method of claim 8 wherein multiple sheets are used on the same object.

12. The method of claim 8 further comprising the step of securing the sheet to the object with a mechanical fastener.

* * * * *